US007812802B2

(12) United States Patent
Lin et al.

(10) Patent No.: US 7,812,802 B2
(45) Date of Patent: Oct. 12, 2010

(54) LIQUID CRYSTAL DISPLAY OVERDRIVE ACCURACY ADJUSTMENT DEVICE AND METHOD

(75) Inventors: Chang-Cheng Lin, Taipei (TW); Yuh-Ren Shen, Tai-Nan (TW); Cheng-Chung Peng, Hsin-Chu (TW)

(73) Assignee: VastView Technology Inc., Hsinchu (TW)

( * ) Notice: Subject to any disclaimer, the term of this patent is extended or adjusted under 35 U.S.C. 154(b) by 847 days.

(21) Appl. No.: 11/675,089

(22) Filed: Feb. 15, 2007

(65) Prior Publication Data

US 2008/0198115 A1 Aug. 21, 2008

(51) Int. Cl.
*G09G 3/36* (2006.01)

(52) U.S. Cl. ..... 345/89

(58) Field of Classification Search ..... 345/690, 345/89

See application file for complete search history.

(56) References Cited

U.S. PATENT DOCUMENTS

2005/0083353 A1* 4/2005 Maruyama et al. ..... 345/690
2006/0152535 A1* 7/2006 Huang et al. ..... 345/690

* cited by examiner

*Primary Examiner*—Chanh Nguyen
*Assistant Examiner*—Tsegaye Seyoum

(57) ABSTRACT

An overdrive accuracy adjustment device and method for use in a liquid crystal display panel is presented. According to a current grayscale value of a pixel in an awaiting to be displayed image and a previous grayscale value of the corresponding pixel in an already-displayed image, the corresponding overdrive grayscale value is found from a look-up table. In order to more efficiently use the limited storage capacity of the look-up table as well as improve the accuracy of the overdrive, in accordance with the physical characteristics of the liquid crystal display panel in particular (in particular to the grayscale values which often require the overdrive), the gap size between the current grayscale values and/or the gap size between the previous grayscale values may be adjusted in the look-up table, without having to increase the quantity of the overdrive grayscale values stored in the look-up table.

1 Claim, 8 Drawing Sheets

| | 0 | 4 | 8 | 12 | 16 | 20 | 24 | . . . |
|---|---|---|---|---|---|---|---|---|
| 0 | | 12 | 21 | 30 | 41 | 53 | 70 | |
| 4 | 0 | | 18 | 23 | 34 | 41 | 57 | |
| 8 | 0 | 1 | | 20 | 27 | 33 | 47 | |
| 12 | 0 | 0 | 4 | | 22 | 28 | 38 | |
| 16 | 0 | 0 | 1 | 5 | | 23 | 31 | |
| 20 | 0 | 0 | 0 | 2 | 6 | | 28 | |
| 24 | 0 | 0 | 0 | 1 | 3 | 7 | | |
| . . . | | | | | | | | |

LIQUID CRYSTAL DISPLAY OVERDRIVE ACCURACY ADJUSTMENT DEVICE AND METHOD

BACKGROUND OF THE INVENTION

1. Field of the Invention

The present invention relates generally to a liquid crystal display overdrive device and method thereof, and in particular to an overdrive accuracy adjustment device and method thereof for obtaining improved response speed of the liquid crystal display and also better image quality.

2. The Prior Arts

Referring to FIG. 1A to FIG. 1B, a conventional drive method is shown in FIG. 1A to FIG. 1B. As shown in FIG. 1A in the conventional drive method, when a grayscale value of $g_0$ is switched into $g_1$ at time $t_0$, the corresponding pixel brightness is switched from $Y_0$ into $Y_1$. However, the response time during the switching of the pixel brightness from $Y_0$ to $Y_1$ is exceedingly prolonged such that the pixel brightness cannot reach the predetermined $Y_1$ within a pixel period.

As shown in FIG. 1B, the overdrive method has been disclosed to overcome the problem as mentioned above. The pixel brightness can reach the predetermined Y1 within a pixel period. In this pixel period, the overdrive grayscale value ($g_1$') required by the overdrive would be related to the previous grayscale value ($g_0$) and the current grayscale value ($g_1$).

Referring to FIG. 2A to FIG. 2C, a conventional drive device is shown in FIG. 2A to FIG. 2C. As shown in FIG. 2A, a conventional drive device includes a look-up table 10 for the 3 gamma values, a memory controller 12, a memory 14, and an overdrive module 16. The conventional device constructed by the overdrive module 16 can perform the overdrive as shown in FIG. 1B. The look-up table 10 (for 3 gamma values or the gamma curve) converts the grayscale values received to the proper drive voltages. And then the memory controller 12 receives the pixel values from the look-up table 10 and stores the pixel values inside the memory 14. The overdrive module 16 receives the current grayscale value ($g_1$) and the previous grayscale value ($g_0$) from the look-up table 10 (holding the gamma values) and the memory controller 12, respectively, to look up the corresponding overdrive grayscale value ($g_1$') in a built-in look-up table 18, and uses the results inside a liquid crystal display panel.

As shown in FIG. 2B, the look-up table 18 includes a plurality of current grayscale values and a plurality of previous grayscale values which are mutually corresponding to a plurality of overdrive grayscale values. Taking the 256 grayscale as an example, 256×256 overdrive grayscale values would be stored in the look-up table 18. However, under general applications for the sake of reducing storage costs, the quantity of the overdrive grayscale values stored in the look-up table 18 may be only 21×21. In other words, only overdrive grayscale values which are corresponding with a plurality of current grayscale values and a plurality of previous grayscale values having grayscale values of 0, 4, 8, 12 . . . are stored. If it is required to look up the current grayscale value for 21 and the previous grayscale value for 6 as shown in FIG. 2C, interpolation operation is performed.

SUMMARY OF THE INVENTION

However, the overdrive grayscale values ($g_1$') are indeed originally of actual values being measured, and are not determined from using equations. Through the use of the interpolation operation as mentioned above, a problem regarding inaccuracy is introduced.

A primary objective of the present invention is to provide an overdrive accuracy adjustment device and method thereof, which in particular is in accordance with the physical characteristics of the liquid crystal display panel (in particular to the grayscale which often required the overdrive). Without having to increase the quantity of overdrive grayscale values stored in the look-up table, the gap size between a plurality of current grayscale values and/or the gap size between a plurality of previous grayscale values may be adjusted in the look-up table, thereby more efficiently utilizing the limited storage capacity of the look-up table, and improving the accuracy on the overdrive.

Based on the objective as mentioned above in the overdrive accuracy adjustment device of the present invention, the device includes a look-up table (having 3 gamma values), a memory controller, an overdrive module, and an adjustable gamma module which can be connected with the look-up table, the memory controller, or the overdrive module electrically. The look-up table converts a current grayscale value of a pixel received from awaiting pictures, which is yet to be displayed, into an appropriate drive voltage using the gamma curve. The memory controller receives the current grayscale value from the look-up table, which includes the 3 gamma values; and the memory controller stores the current grayscale value in a memory, and the current grayscale value is then to be defined as a previous grayscale value. The overdrive module is electrically connected with the memory controller and the look-up table, and it includes a plurality of current grayscale values and a plurality of previous grayscale values which are mutually associated in one look-up table including a plurality of overdrive grayscale values. According to the current grayscale value of a pixel in an awaiting to be displayed image and the previous grayscale value of the corresponding pixel in an already-displayed image, the corresponding overdrive grayscale value is picked out from the look-up table, and then is to be used in the liquid crystal display panel. The adjustable gamma module is respectively electrically connected with the look-up table (of 3 gamma values) and the memory controller; and the adjustable gamma module includes a plurality of adjustable data. Each adjustable data is using an original grayscale value corresponding to the adjusted grayscale value inside the look-up table to adjust the gaps between the current grayscale values in the look-up table, without increasing the quantity of the overdrive grayscale values stored in the look-up table, and using the adjusted data for adjusting the gap size between the current grayscale values.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

In the overdrive accuracy adjustment method of the present invention, the look-up table remains to be used for obtaining the overdrive grayscale values. The look-up table remains to include a plurality of current grayscale values and a plurality of previous grayscale values which are mutually corresponding to a plurality of overdrive grayscale values. When performing the overdrive, the corresponding overdrive grayscale value can be picked out of the look-up table according to the current grayscale value of a pixel in an awaiting to be displayed image and the previous grayscale value of the corresponding pixel in an already-displayed image. Therefore, in order to use the limited storage capacity of the look-up table more efficiently without increasing the quantity of the overdrive grayscale values, and also refraining from relying on the interpolation operation for estimating the overdrive grayscale values for improving the accuracy of the overdrive, a plurality of embodiments are provided. According to the physical characteristics of the liquid crystal display panel in particular (in particular to the grayscale values which often required the overdrive), the gaps between a plurality of current grayscale values and/or previous grayscale values with respect to each other should be adjusted by using the overdrive accuracy adjustment device and method thereof in the present invention to thereby more efficiently use the limited storage capacity of the look-up table as well as improve the accuracy of the overdrive. In below, there are two embodiments for illustrating the method for adjusting the gap sizes between a plurality of current grayscale values and/or the previous grayscale values with respect to each other, respectively.

Figure 1B:
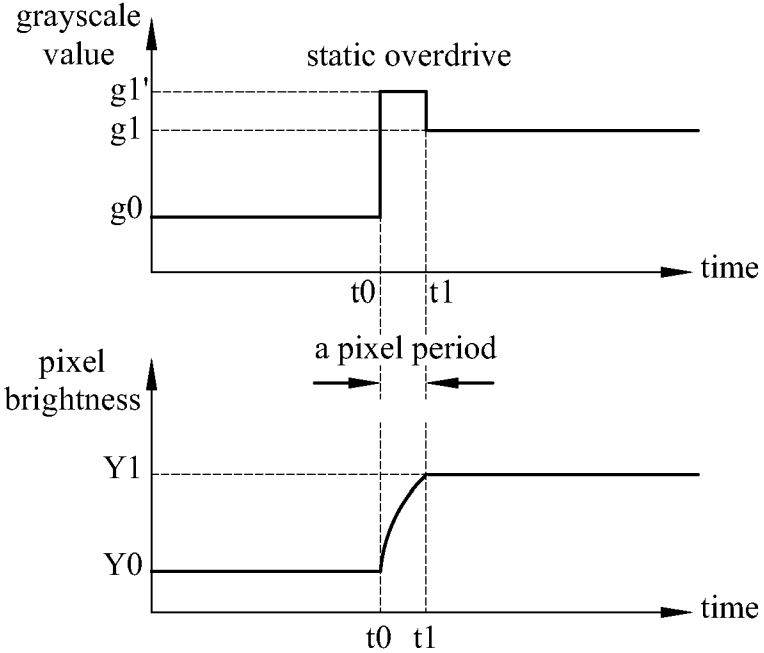
FIG. 1B (PRIOR ART)
FIG. 1A to FIG. 1B are a plurality of schematic views showing a conventional drive method.
Figure 1A:
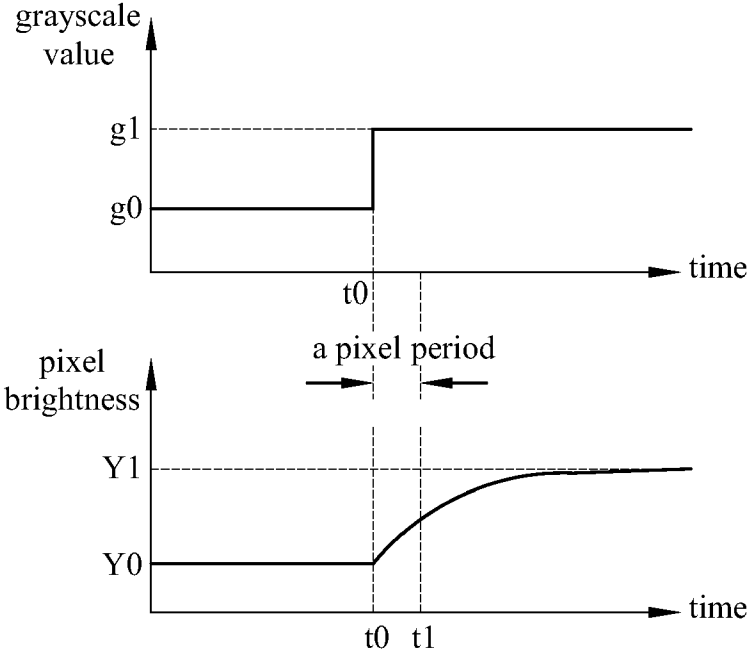
FIG. 1A (PRIOR ART)
Figure 2A:
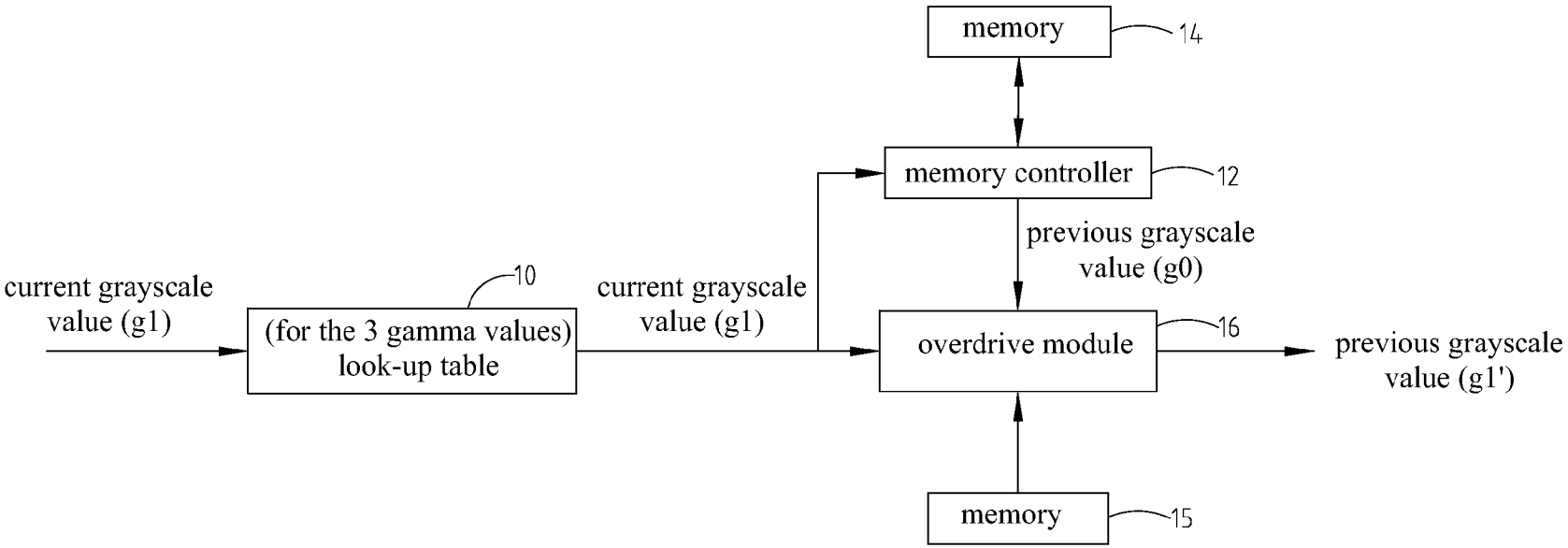
FIG. 2A (PRIOR ART)
FIG. 2A to FIG. 2C are a plurality of schematic views showing a conventional drive device.
Figure 2C:
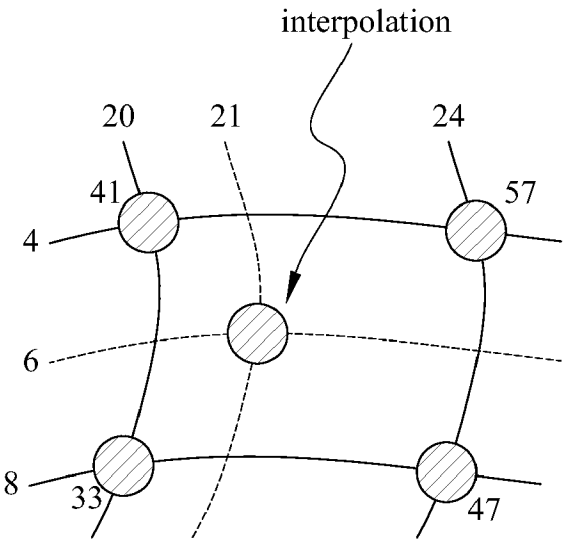
FIG. 2C (PRIOR ART)
Figure 2B:
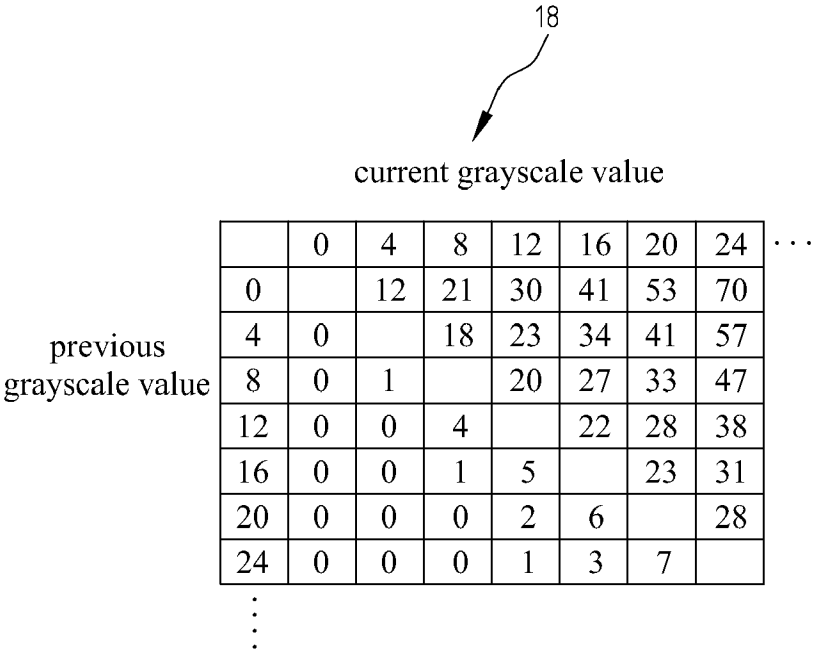
FIG. 2B (PRIOR ART)
Figure 3A:
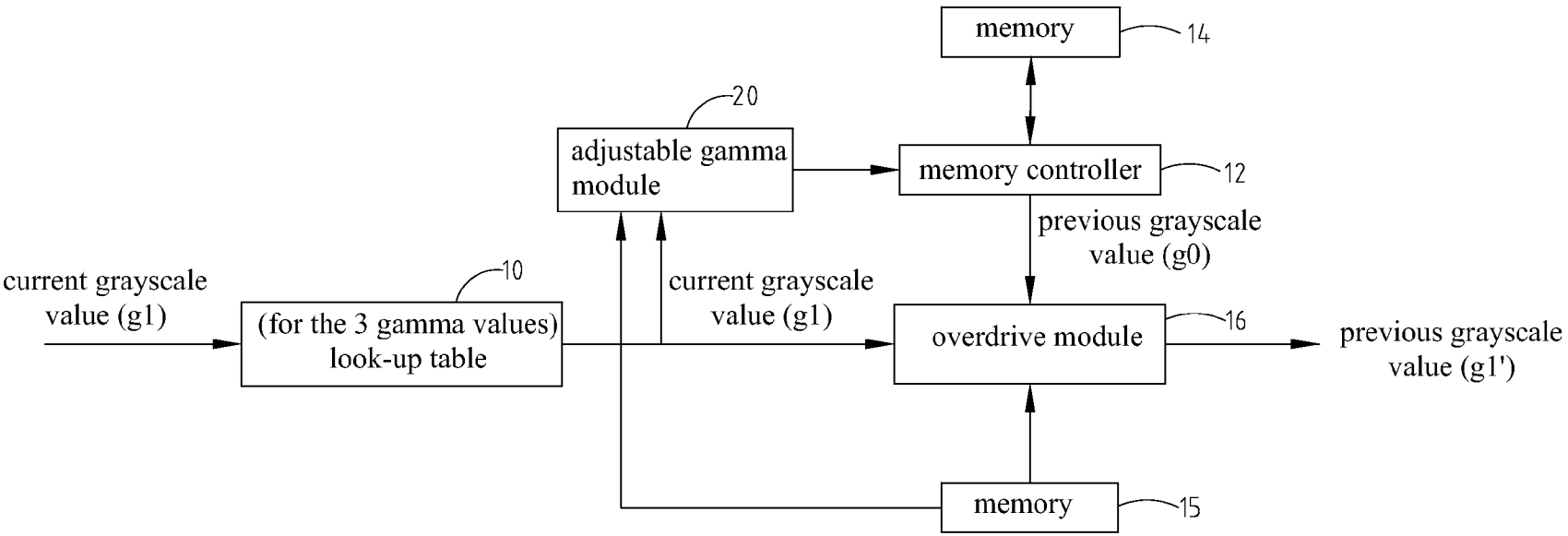
FIG. 3A to FIG. 3C are a plurality of schematic views showing an overdrive accuracy adjustment device according to a first embodiment of the present invention.
Figure 3B:
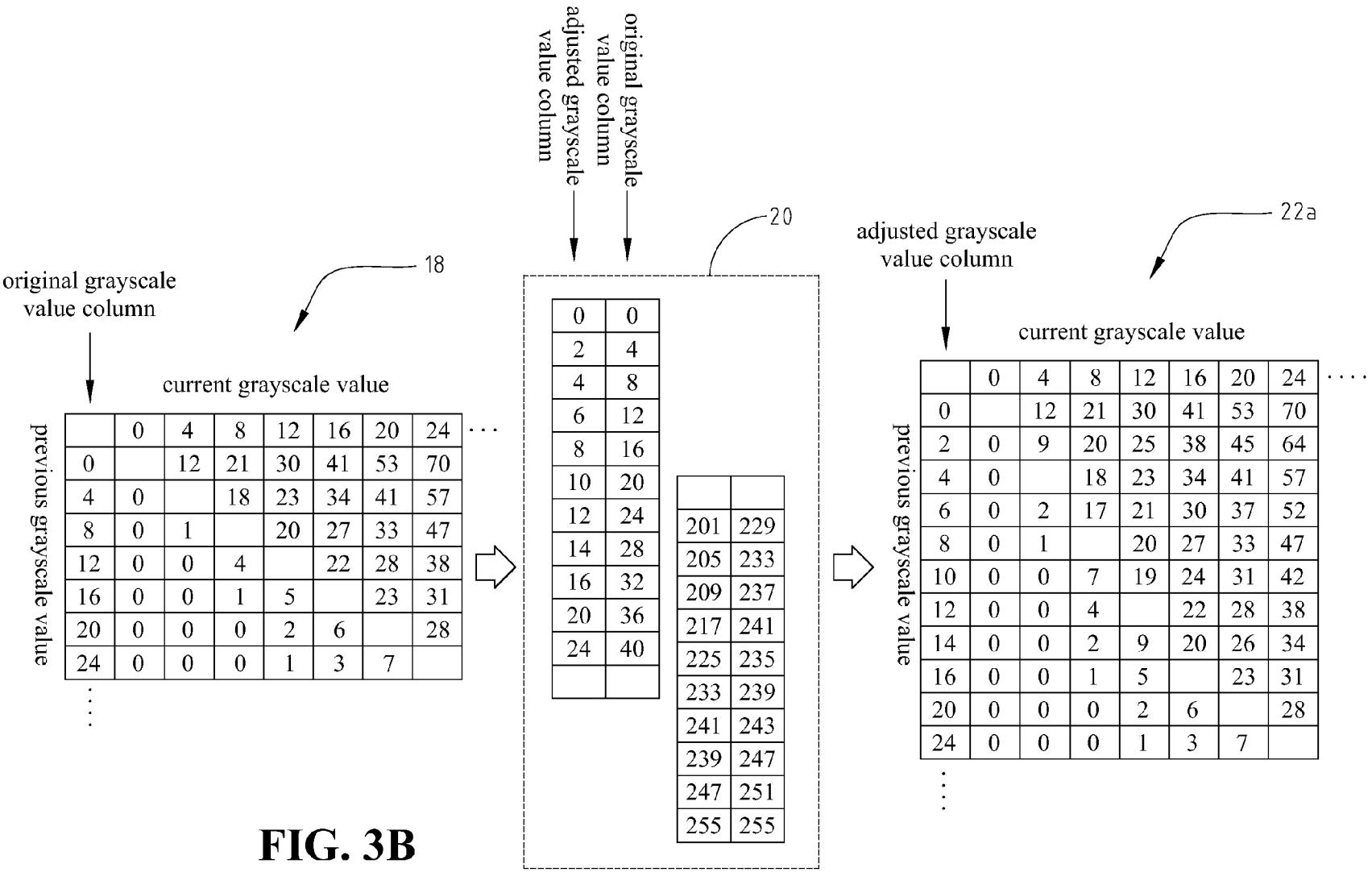
Figure 3C:
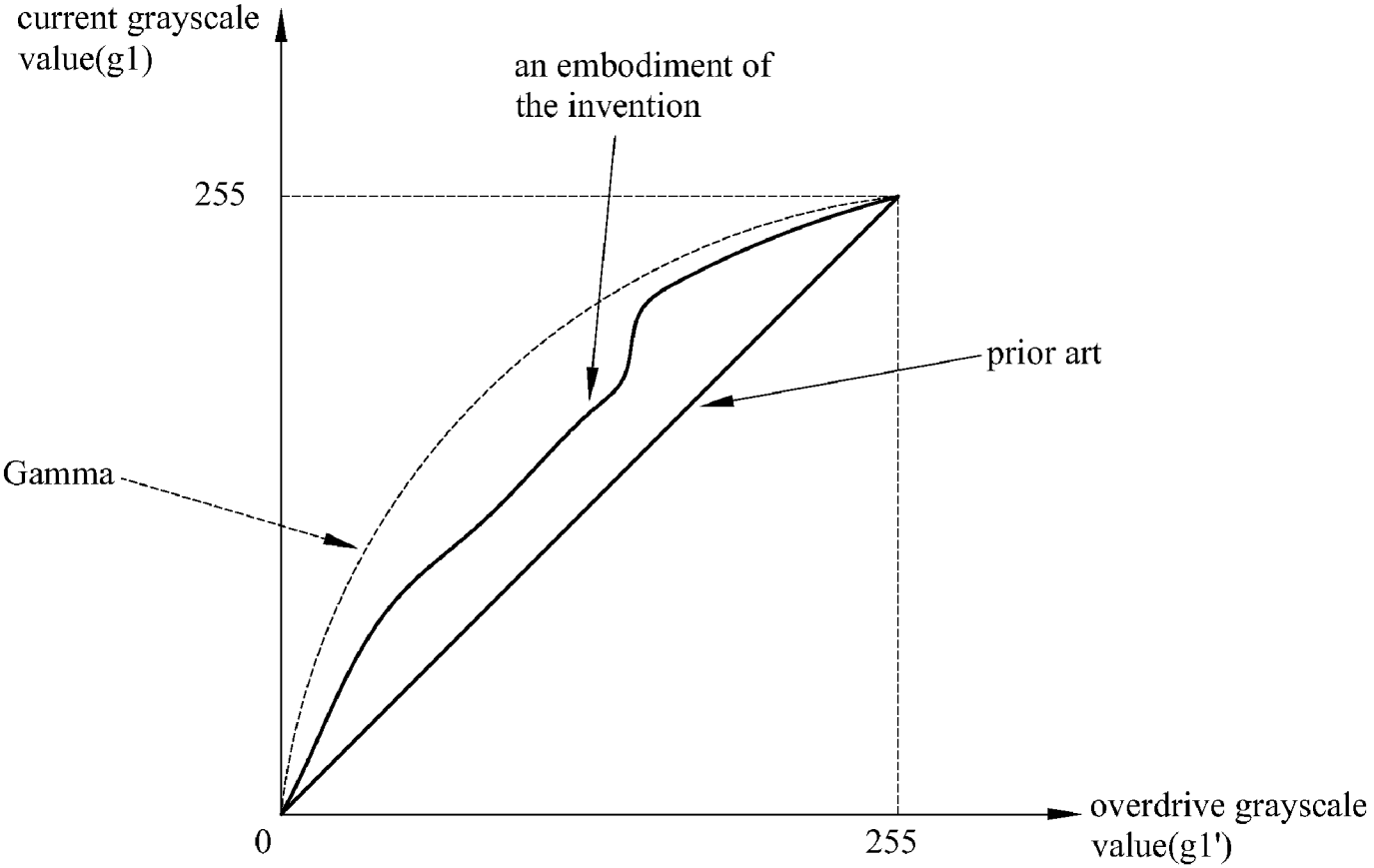

Referring to FIG. 3A to FIG. 3C, the overdrive accuracy adjustment device according to a first embodiment of the present invention is shown in FIG. 3A to FIG. 3C. As shown in FIG. 3A, the drive device of the present invention includes a look-up table 10 (including 3 gamma values), a memory controller 12, a memory 14, and an overdrive module 16, and also can further include an adjustable gamma module 20. The adjustable gamma module 20 is electrically connected with the look-up table 10 (having 3 gamma values) and the memory controller 12, respectively.

When the current grayscale value of the pixel in the awaiting to be displayed image has been received, the look-up table 10 or the gamma curve can be used to convert the current grayscale value to the proper drive voltage. Then, the current grayscale value from the look-up table 10 is transmitted to the memory controller 12 through the adjustable gamma module 20; and the current grayscale value, received by the memory controller 12, is to be stored in the memory 14. The current grayscale value is then defined as the previous grayscale value. Similarly as in conventional technology, the overdrive module 16 remains to be electrically connected with the memory controller 12 and the look-up table 10, respectively; and the overdrive module 16 includes the look-up table as mentioned above. The overdrive module 16 remains to look up the corresponding overdrive grayscale values from the look-up table according to the current grayscale value of one of the pixels in the awaiting to be displayed image and the previous grayscale value of the corresponding pixel in the already-displayed image, and the corresponding overdrive grayscale values are found or determined from the look-up table 10, and the overdrive grayscale values are used to drive the liquid crystal display panel.

In order to improve the accuracy of the overdrive, the adjustable gamma module 20 can include a plurality of adjustable data as shown in FIG. 3B. Each adjusted data is to be made by comparing a column of the original grayscale values in the look-up table 18 with a column of the grayscale values that had been adjusted in the look-up table 22*a* one by one. Thus, the adjustable gamma module 20 can adjust the gap size in between the current grayscale values in the look-up table 18 using the adjusted data, without increasing the total quantity of the overdrive grayscale values stored in the look-up table 22*a*. In addition, the corresponding overdrive grayscale values are to be filled in the added fields.

In detail, according to the results of the experiments when a particular liquid crystal display panel is to be defined in the high and low grayscale values, the overdrive grayscale values are often needed to be looked up. In order to reduce the calculating of overdrive grayscale values by using the interpolation operations, the gap densities of the current grayscale values in the high and low grayscale values are increased in particular. The original 0, 4, 8, 12 . . . is adjusted to 0, 2, 4, 6, 8, 10, 12 . . . , so as to form the comparative diagram showing the current grayscale values ($g_1$) and the overdrive grayscale values ($g_1'$), as shown in FIG. 3C. An important fact is that regardless whether it is the columns/rows of the grayscale values adjusted or the columns/rows of the original grayscale values, there is no particular mode for defining the gap sizes, which are mainly adjusted based upon practical requirements.

Figure 4A:
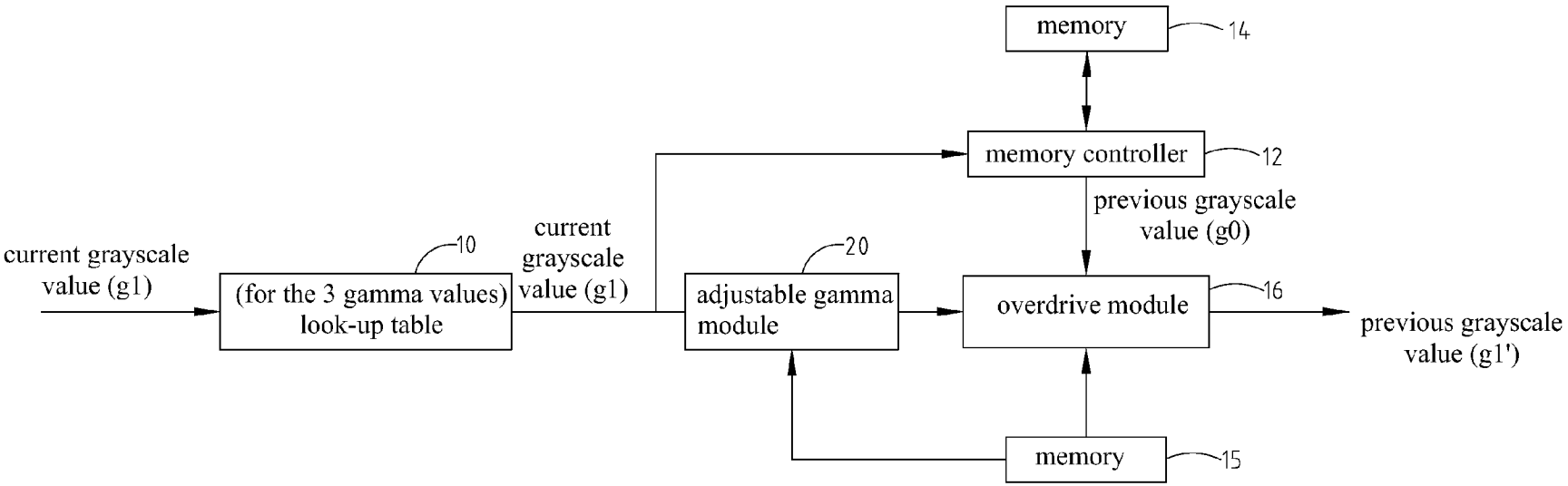
FIG. 4A to FIG. 4B are a plurality of schematic views showing another overdrive accuracy adjustment device according to a second embodiment of the present invention.
Figure 4B:
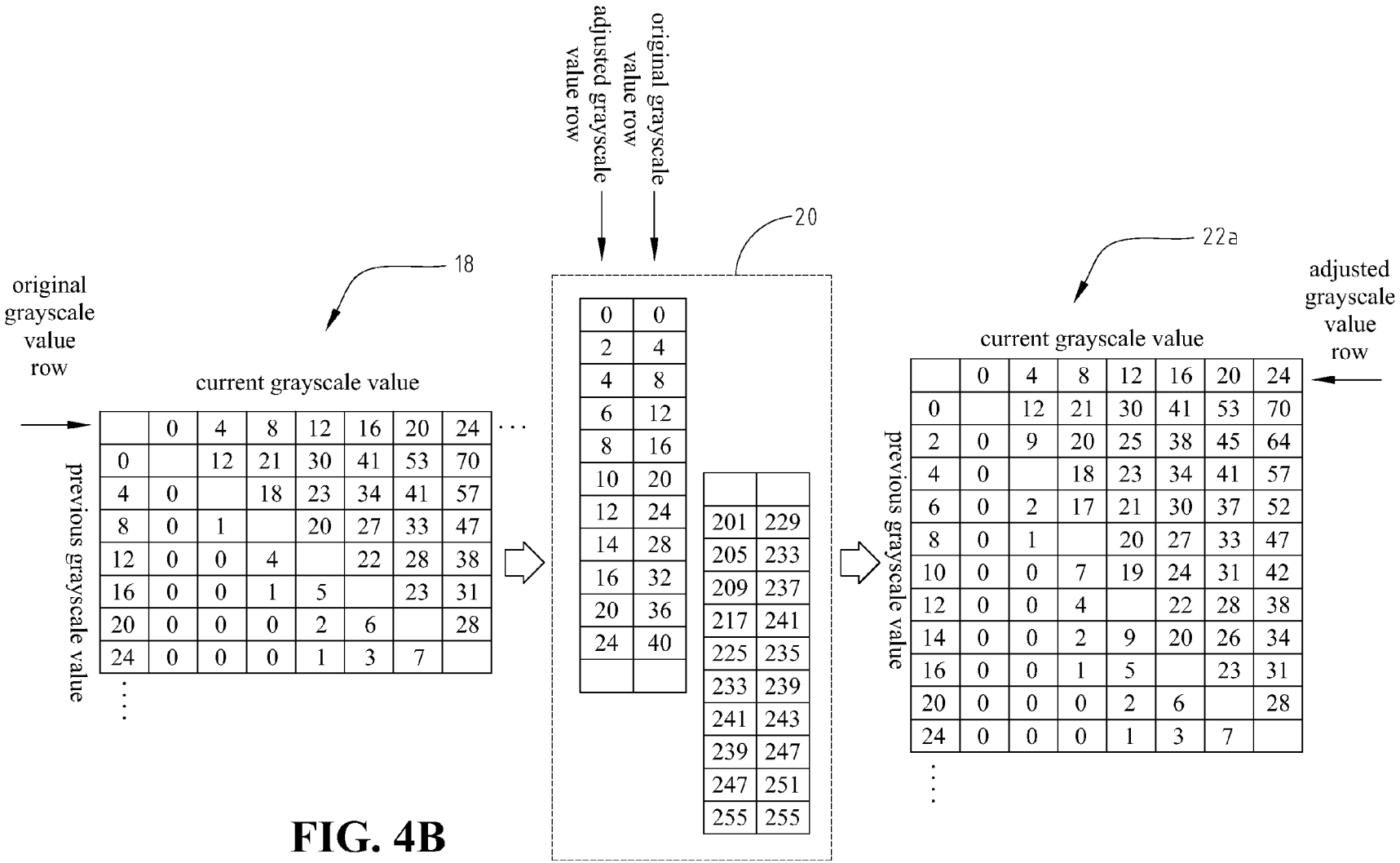

Referring to FIG. 4A to FIG. 4B, the overdrive accuracy adjustment device and method thereof according to a second embodiment of the present invention is shown in FIG. 4A to FIG. 4B. As shown in FIG. 4A, the drive device of the present invention also includes a look-up table 10 (having 3 gamma values), a memory controller 12, a memory 14, an overdrive module 16, and also further to include an adjustable gamma module 20. The adjustable gamma module 20 is electrically connected with the look-up table 10 and the overdrive module 16, respectively.

As shown in FIG. 4B, in the second embodiment, the adjustable gamma module 20 adjusts the gaps between the previous grayscale values with respect to each other in the look-up table 18 using the adjusted data (an original grayscale value row is corresponding to an adjusted grayscale value row one by one) so as to form the look-up table 22*b*.

In the overdrive accuracy adjustment method for liquid crystal display panel, besides using the adjustable gamma module 20 for adjusting the gap densities between the current grayscale values and/or the previous grayscale values, the accuracy gap between the current grayscale values and/or the previous grayscale values can be adjusted dynamically in the original look-up table 18, in accordance with the physical characteristics of the liquid crystal display panel directly, according to the current grayscale value of a pixel in an awaiting to be displayed image and the previous grayscale value of the corresponding pixel in an already-displayed image so as to determine the corresponding overdrive grayscale values, and to input the overdrive grayscale values into the liquid crystal display panel. The corresponding overdrive grayscale values are of non-equidistance values. In other words, whether by dynamic adjustments using the LUT or performing adjustments through using equations for calculations does not go beyond the spirits of the present invention.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An overdrive accuracy adjustment device for use in a liquid crystal display panel, comprising:

a gamma-value look-up table, for looking up gamma values, and converting a current grayscale value of a pixel received from an awaiting to be displayed image to a proper drive voltage;

a memory controller, receiving the current grayscale value from the gamma-value look-up table, storing the current grayscale value in a memory, and defining the current grayscale value to be a previous grayscale value of a corresponding pixel in an already-displayed image;

an overdrive module, electrically connecting with the memory controller and the gamma-value look-up table, and comprising a built-in look-up table formed by a plurality of current grayscale values and a plurality of previous grayscale values mutually corresponding to a plurality of overdrive grayscale values according to the current grayscale value of one of the pixels in the awaiting to be displayed image and the previous grayscale value of the corresponding pixel in the already-displayed image, and the corresponding overdrive grayscale value being found from the built-in look-up table for driving the liquid crystal display panel; and an adjustable gamma module, electrically connecting with the gamma-value look-up table and the memory controller, and comprising a plurality of adjusted data, and each adjusted data being used for adjusting a gap size between the current grayscale values in the built-in look-up table of the overdrive module, and the adjusted data being made by comparing a row of original grayscale values with a row of the grayscale values that have been adjusted one by one, without increasing a quantity of the overdrive grayscale values stored in the built-in look-up table.

* * * * *